US006669187B1

(12) United States Patent
Clark

(10) Patent No.: US 6,669,187 B1
(45) Date of Patent: Dec. 30, 2003

(54) REAR JET AIR KNIFE

(75) Inventor: Robert A. Clark, Webster, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/172,103

(22) Filed: Jun. 13, 2002

(51) Int. Cl.[7] ..... B65H 3/14

(52) U.S. Cl. ..... 271/98; 271/97; 271/104; 271/106

(58) Field of Search ..... 271/97, 98, 104, 271/106

(56) References Cited

U.S. PATENT DOCUMENTS

| | | | | | |
|---|---|---|---|---|---|
| 4,418,905 | A | * | 12/1983 | Garavuso | 271/98 |
| 4,462,586 | A | * | 7/1984 | Browne et al. | 271/94 |
| 4,596,385 | A | * | 6/1986 | Silverberg | 271/94 |
| 4,887,805 | A | * | 12/1989 | Herbert et al. | 271/94 |
| 5,181,706 | A | * | 1/1993 | Yamamoto et al. | 271/11 |
| 5,344,133 | A | * | 9/1994 | Jantsch et al. | 271/94 |
| 5,478,066 | A | * | 12/1995 | Yoshida et al. | 271/12 |
| 5,707,056 | A | * | 1/1998 | Rauen et al. | 271/96 |
| 5,921,540 | A | * | 7/1999 | Acquaviva et al. | 271/98 |
| 6,015,144 | A | * | 1/2000 | Yoshii et al. | 271/97 |
| 6,082,728 | A | * | 7/2000 | Ubayashi | 271/108 |
| 6,264,188 | B1 | * | 7/2001 | Taylor et al. | 271/98 |
| 6,352,255 | B1 | * | 3/2002 | Taylor | 271/104 |
| 6,398,206 | B1 | * | 6/2002 | Yang et al. | 271/90 |
| 6,398,207 | B1 | * | 6/2002 | Taylor et al. | 271/106 |
| 6,398,208 | B1 | * | 6/2002 | Yang et al. | 271/107 |
| 2002/0047235 | A1 | * | 4/2002 | Allner et al. | 271/98 |

FOREIGN PATENT DOCUMENTS

| | | | | |
|---|---|---|---|---|
| EP | 361259 A1 | * | 4/1990 | B65H/3/12 |
| JP | 04358637 A | * | 12/1992 | B65H/3/12 |

* cited by examiner

*Primary Examiner*—Donald P. Walsh
*Assistant Examiner*—Matthew J. Kohner
(74) *Attorney, Agent, or Firm*—Perman & Green, LLP

(57) ABSTRACT

A top sheet feeding apparatus for feeding sheets from a stack of sheets is disclosed. The feeding apparatus comprises a sheet stack support tray for supporting a stack of sheets, an air knife device positioned immediately adjacent the front of the stack of sheets for applying a positive pressure to the sheet stack in order to separate the uppermost sheet in the stack from the rest of the stack, and a feedhead device including a vacuum plenum chamber positioned over the front of the sheet stack having a negative pressure applied thereto during feeding, the vacuum plenum chamber having a sheet corrugation member located in the center of its bottom surface and perforated feed belt means associated with the vacuum plenum chamber to transport the sheets acquired by said vacuum plenum chamber in a forward direction out of the stack support tray. The air knife device includes a pair of straight air nozzles extending from the rear portion of the air knife device.

8 Claims, 9 Drawing Sheets

REAR JET AIR KNIFE

BACKGROUND OF THE INVENTION

1. Field of the Invention

The present invention relates to an improved sheet feeding apparatus, and in particular, to a high speed sheet feeding apparatus which feeds sheets from a top sheet in a stack of sheets and which also employs an improved air knife device for improved separation features. In one embodiment of this invention the present invention relates to an electrophotographic machine and a top sheet feeding apparatus for use in such a machine.

2. Description of Prior Developments

In the process of electrostatographic reproduction, a light image of an original to be copied or printed is typically recorded in the form of a latent electrostatic image upon a photosensitive member, with a subsequent rendering of the latent image visible by the application of electroscopic marking particles, commonly referred to as toner. The visual toner image can be either fixed directly upon the photosensitive member or transferred from the member to another support medium, such as a sheet of plain paper. To render this toner image permanent, the image must be "fixed" or "fused" to the paper, generally by the application of heat and pressure. The electrostatographic reproduction process is a good example of a process that involves a great deal of fast and controlled movement of sheets or paper.

With currently known high speed xerographic copy reproduction machines wherein copies can be produced at a rate in excess of several thousand copies per hour, the need for a sheet feeder to feed cut copy sheets to the machine in a rapid, dependable manner was recognized to enable full utilization of the reproduction machine's potential copy output. In particular, for many purely duplicating operations, it is desired to feed cut copy sheets at very high speeds where multiple copies are made of an original placed on a copying platen. In addition, for many high speed copying operations, a document handler to feed documents from a stack to a copy platen of the machine in a rapid and dependable manner has also been reorganized to enable full utilization of the machine's potential copy output. These sheet feeders must operate flawlessly to virtually eliminate the risk of damaging the sheets and generate minimum machine shutdowns due to uncorrectable misfeeds or sheet multifeeds. It is in the initial separation of the individual sheets from a stack of sheets where the greatest number of problems occurs.

Since the sheets must be handled gently, but positively to assure separation without damage through a number of cycles, a number of different types of separators have been previously suggested. These include separators, such as friction rolls or belts used for fairly positive document feeding in conjunction with a retard belt, pad, or roll to prevent multifeeds. Vacuum separators such as sniffer tubes, rocker type vacuum rolls, or vacuum feed belts have also been utilized.

While the friction roll-retard systems are generally very positive, the action of the retard member, if it acts upon the printed face, can cause smearing or partial erasure of the printed material on the document. With single sided documents if the image is against the retard mechanism, it can be smeared or erased. On the other hand, if the image is against the feed belt it smears through ink transfer and offset back to the paper. However, with documents printed on both sides the problem is compounded. Additionally, the reliable operation of friction retard feeders is highly dependent on the relative frictional properties of the paper being handled. This cannot be controlled in a document feeder.

One of the sheet feeders best known for high-speed operation is the top vacuum corrugation feeder in combination with a front air knife. In this type of system, a vacuum plenum with a plurality of friction belts that are arranged to run over the vacuum plenum is placed at the top of a stack of sheets in a supply tray. At the front of the stack, an air knife is used to inject air into the stack to separate the top sheet from the remainder of the stack. In operation, air is injected by the air knife toward the stack to separate the top sheet and the vacuum pulls the separated sheet up and acquires it. Following acquisition, the belt transport drives the sheet forward off the stack of sheets. In this type of configuration, separation of the next sheet cannot take place until the top sheet had cleared the stack. In addition, acquisition of the next sheet in the stack cannot occur until the top sheet has cleared the vacuum plenum. In this type of feeding system every operation takes place in succession or serially, and therefore the feeding of subsequent sheets cannot be started until the feeding of the previous sheet has been completed. This procedure takes time and therefore limits the potential operational speed of the sheet feeder. In such a system in order to try to increase the throughput speed, it has been proposed to activate the vacuum and the transport belts continuously. This frequently results in a difficulty in acquiring the top sheet in a stack since it must be acquired by a vacuum over which friction belts are moving. In addition, the second sheet can be prematurely acquired as the trail edge of the sheet partially clears the vacuum plenum. An overlay multifeed may occur that must be separated with another device. Thus, the inherent structure in such a system limits its potential operational speed.

A sheet feeder in answer to the above-mentioned issue is described in U.S. Pat. No. 4,451,028 in which a rear air knife vacuum corrugation feeder is disclosed that uses a moving carriage to position an air knife assembly as well as a rear vacuum assembly with respect to the trail edge of a copy sheet stack. However, the need to use a movable carriage to accommodate media of different sizes adds an added cost burden to the overall apparatus. There is also the system described in U.S. Pat. No. 4,699,369 which is an example of the use of a front air knife for a top vacuum feeder. Finally, a preferred feeding apparatus for the invention described herein is described in U.S. Pat. No. 6,624,188, in which the top sheet is acquired by a feedhead containing a plurality of corrugating ribs, separated from any other acquired sheets, and then transported to the paper path entrance.

SUMMARY OF THE INVENTION

It is a primary objective of the present invention to avoid the various disadvantages of prior art type sheet feeder devices, as described above and provide a modification to traditional air knife device designs which significantly improves air knife performance by creating high stagnation pressure area at intersheet gaps created the corrugation pattern positioned on a feedhead, thereby enhancing initial sheet separation. When combined with a multiple corrugation scheme on the feedhead, the rear jet air knife in accordance with the features of the present invention outperforms prior art type air knifes while requiring an operating pressure that is seventy-five percent (75%) less. This improvement should result in a significant reduction in unit material cost for the air source while also lowering feeder noise.

The overall objectives of this invention and other advantages over the prior art are achieved by a top sheet feeding apparatus for feeding sheets from a stack of sheets comprising a sheet stack support tray for supporting a stack of sheets, an air knife device positioned adjacent the front of the stack of sheets for applying a positive pressure to the sheet stack in order to separate the uppermost sheet in the stack from the rest of the stack, and a feedhead device including a vacuum plenum chamber positioned over the front of the sheet stack having a negative pressure applied thereto during feeding, the vacuum plenum chamber having a member in the form of a sheet corrugation pattern located in the center of its bottom surface and a translating associated with the vacuum plenum chamber to transport the sheets acquired by said vacuum plenum chamber in a forward direction out of the stack support tray, wherein the air knife device includes a pair of straight air nozzles extending from the rear portion of the air knife device.

BRIEF DESCRIPTION OF THE DRAWINGS

The foregoing aspects and other features of the present invention are explained in the following description, taken in connection with the accompanying drawings, wherein.

DETAILED DESCRIPTION OF THE PREFERRED EMBODIMENTS

Figure 1:
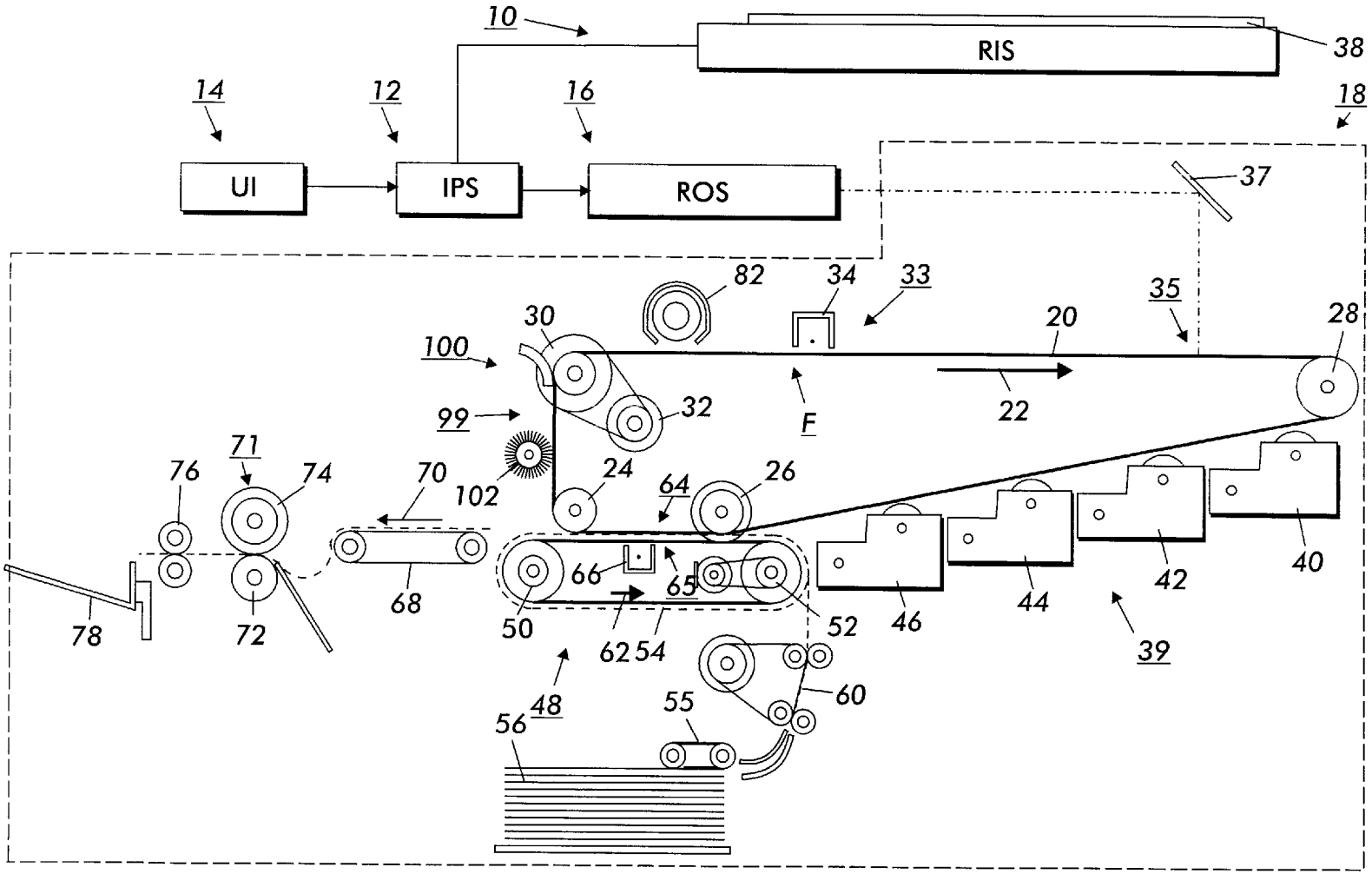
FIG. 1 is a schematic plan view of an example of an electrophotographic printing apparatus that can employ a top sheet feeding apparatus having the features of the present invention.

Referring to FIG. 1, a perspective view of a system 10 incorporating features of the present invention is illustrated. Although the present invention will be described with reference to the embodiment shown in the drawings, it should be understood that the present invention can be embodied in many alternate forms of embodiments. In addition, any suitable size, shape or type of elements or materials could be used.

While the present invention will hereinafter be described in connection with preferred embodiments, it will be understood that it is not intended to limit the invention to any one particular embodiment.

For a general understanding of the features of the present invention, reference is made to the drawings. In the drawings, like reference numerals have been used throughout to designate like elements. It will become evident from the following discussion that the present invention and the various embodiments set forth herein are suited for use in a wide variety of printing and xerographic copying systems, and are not necessarily limited in its application to the particular systems shown or described herein.

By way of a general explanation, FIG. 1 is a schematic elevational view showing an electrophotographic printing machine which can incorporate features of the present invention therein. It will become evident from the following discussion that the present invention is equally well suited for use in a wide variety of copying and printing systems, and is not necessarily limited in its application to the particular system shown herein. As shown in FIG. 1, during operation of the printing system, a color or black/white original document 38 is positioned on a raster input scanner (RIS), indicated generally by the reference numeral 10. The RIS contains document illumination lamps, optics, a mechanical scanning drive, and a charge coupled device (CCD array). The RIS captures the entire image from original document 38 and converts it to a series of raster scan lines and moreover measures a set of primary color densities, i.e. red, green and blue densities, at each point of the original document. This information is transmitted as electrical signals to an image processing system (IPS), indicated generally by the reference numeral 12. IPS 12 converts the set of red, green and blue density signals to a set of calorimetric coordinates.

IPS 12 contains control electronics which prepare and manage the image data flow to a raster output scanner (ROS), indicated generally by the reference numeral 16. A user interface (UI), indicated generally by the reference numeral 14, is in communication with IPS 12. UI 14 enables an operator to control the various operator adjustable functions. The operator actuates the appropriate keys of UI 14 to adjust the parameters of the copy. UI 14 may be a touch screen, or any other suitable control panel, providing an operator interface with the system. The output signal from UI 14 is transmitted to IPS 12. IPS 12 then transmits signals corresponding to the desired image to ROS 16, which creates the output copy image. ROS 16 includes a laser with rotating polygon mirror blocks. Preferably, a nine facet polygon is used. ROS 16 illuminates, via mirror 37, the charged portion of a photoconductive belt 20 of a printer or marking engine, indicated generally by reference numeral 18, at a rate of about 400 pixels per inch, to achieve a set of subtractive primary latent images. ROS 16 will expose the photoconductive belt 20 to record three latent images which correspond to the signals transmitted from IPS 12. One latent image is developed with cyan developer material. Another latent image is developed with magenta developer material and the third latent image is developed with yellow developer material. These developed images are transferred to a copy sheet in superimposed registration with one another to form a multicolored image on the copy sheet. This multicolored image is then fused to the copy sheet forming a color copy.

With continued reference to FIG. 1, printer or marking engine 18 is an electrophotographic printing machine. Photoconductive belt 20 of marking engine 18 is preferably made from a polychromatic photoconductive material. The photoconductive belt 20 moves in the direction of arrow 22 to advance successive portions of the photoconductive surface sequentially through the various processing stations disposed about the path of movement thereof. Photoconductive belt 20 is entranied about transfer rollers 24 and 26, tensioning roller 28, and drive roller 30. Drive roller 30 is rotated by a motor 32 coupled thereto by suitable means such as a belt drive. As roller 30 rotates, it advances belt 20 in the direction of arrow 22.

Initially, a portion of photoconductive belt 20 passes through a charging station, indicated generally by the reference numeral 33. At charging station 33, a corona generating device 34 charges photoconductive belt 20 to a relatively high, substantially uniform potential.

Next, the charged photoconductive surface is rotated to an exposure station, indicated generally by the reference numeral 35. Exposure station 35 receives a modulated light beam corresponding to information derived by RIS 10 having multicolored original document 38 positioned thereat. The modulated light beam impinges on the surface of photoconductive belt 20. The beam illuminates the charged portion of the photoconductive belt to form an electrostatic latent image. The photoconductive belt 20 is exposed three times to record three latent images thereon.

After the electrostatic latent images have been recorded on photoconductive belt 20, the belt advances such latent images to a development station, indicated generally by the reference numeral 39. The development station includes four individual developer units indicated by reference numerals 40, 42, 44, and 46. The developer units are of a type generally referred to in the art as "magnetic brush development units." Typically, a magnetic brush development system employs a magnetizable developer material including magnetic carrier granules having toner particles adhering triboelectrically thereto. The developer material is continually brought through a directional flux field to form a brush of developer material. The developer material is constantly moving so as to continually provide the brush with fresh developer material. Development is achieved by bringing the brush of developer material into contact with the photoconductive surface. Developer units 40, 42, and 44, respectively, apply toner particles of a specific color which corresponds to the compliment of the specific color separated electrostatic latent image recorded on the photoconductive surface.

The color of each of the toner particles is adapted to absorb light within a preselected spectral region of the electromagnetic wave spectrum. For example, an electrostatic latent image formed by discharging the portions of charge on the photoconductive belt 20 corresponding to the green regions of the original document will record the red and blue portions as areas of relatively high charge density on photoconductive belt 20, while the green areas will be reduced to a voltage level ineffective for development. The charged areas are then made visible by having developer unit 40 apply green absorbing (magenta) toner particles onto the electrostatic latent image recorded on photoconductive belt 20. Similarly, a blue separation is developed by developer unit 42 with blue absorbing (yellow) toner particles, while the red separation is developed by developer unit 44 with red absorbing (cyan) toner particles. Developer unit 46 contains black toner particles and may be used to develop the electrostatic latent image formed from a black and white original document. Each of the developer units is moved into and out of an operative position. In the operative position, the magnetic brush is substantially adjacent the photoconductive belt, while in the nonoperative position, the magnetic brush is spaced therefrom. (In FIG. 1, each developer unit 40, 42, 44, and 46 is shown in the operative position.) During development of each electrostatic latent image, only one developer unit is in the operative position, while the remaining developer units are in the nonoperative position. This ensures that each electrostatic latent image is developed with toner particles of the appropriate color without commingling.

After development, the toner image is moved to a transfer station, indicated generally by the reference numeral 65. Transfer station 65 includes a transfer zone, generally indicated by reference numeral 64. In transfer zone 64, the toner image is transferred to a sheet of support material, such as plain paper amongst others. At transfer station 65. At transfer station 65 a sheet transport apparatus, indicated generally by the reference numeral 48, moves the sheet into contact with photoconductive belt 20. Sheet transport 48 has a pair of spaced belts 54 entrained about a pair of substantially cylindrical rollers 50 and 52. A sheet gripper (not shown in FIG. 1) extends between belts 54 and moves in unison therewith. A sheet is advanced from a stack of sheets 56 disposed on a tray. A feeder [58] 55 according to the present invention advances the uppermost sheet from stack 56 onto a pre-transfer transport 60. Transport 60 advances a sheet (not shown in FIG. 1) to sheet transport 48. The sheet is advanced by transport 60 in synchronism with the movement of the sheet gripper. In this way, the leading edge of the sheet arrives at a preselected position, i.e. a loading zone, to be received by the open sheet gripper. The sheet gripper then closes securing the sheet thereto for movement therewith in a recirculating path. The leading edge of the sheet is secured releasably by the sheet gripper. As belts 54 move in the direction of arrow 62, the sheet moves into contact with the photoconductive belt 20, in synchronism with the toner image developed thereon. In transfer zone 64, a gas directing mechanism (not shown in FIG. 1) directs a flow of gas onto the sheet to urge the sheet toward the developed toner image on photoconductive belt 20 so as to enhance contact between the sheet and the developed toner image in the transfer zone. Further, in transfer zone 64, a corona generating device 66 charges the backside of the sheet to the proper magnitude and polarity for attracting the toner image from photoconductive belt 20 thereto. The sheet remains secured to the sheet gripper so as to move in a recirculating path for three cycles. In this way, three different color toner images are transferred to the sheet in superimposed registration with one another.

One skilled in the art will appreciate that the sheet may move in a recirculating path for four cycles when under color black removal is used. Each of the electrostatic latent images recorded on the photoconductive surface is developed with the appropriately colored toner and transferred, in superimposed registration with one another, to the sheet to form the multicolor copy of the colored original document.

After the last transfer operation, the sheet transport system directs the sheet to a vacuum conveyor 68. Vacuum conveyor 68 transports the sheet, in the direction of arrow 70, to a fusing station, indicted generally by the reference numeral 71, where the transferred toner image is permanently fused to the sheet. The fusing station includes a heated fuser roll 74 and a pressure roll 72. The sheet passes through the nip defined by fuser roll 74 and pressure roll 72. The toner image contacts fuser roll 74 so as to be affixed to the sheet. Thereafter, the sheet is advanced by a pair of rolls 76 to a catch tray 78 for subsequent removal therefrom by the machine operator.

The final processing station in the direction of movement of photoconductive belt 20, as indicated by arrow 22, is a photoreceptor cleaning station.

Further details of the technology, construction and operation of feeder station 58 in accordance with the features of the present invention are provided hereinbelow.

Figure 2:
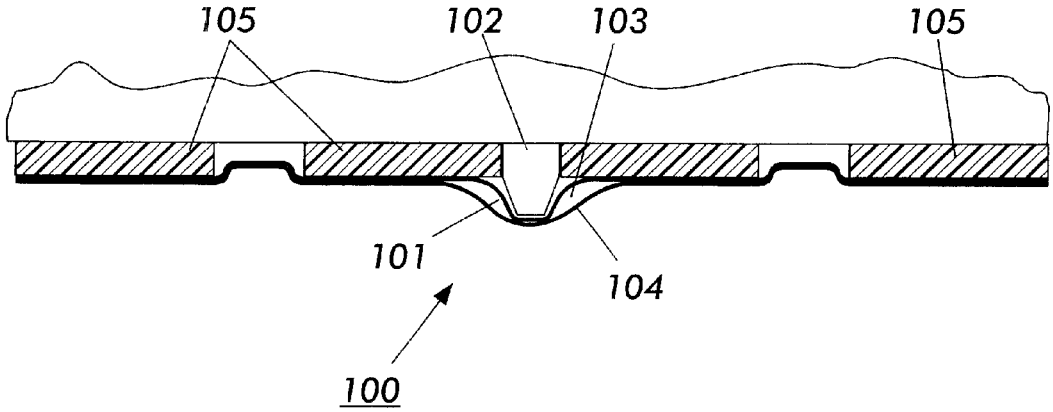
FIG. 2 is a schematic plan front view of a vacuum corrugated feed head; illustrating the gap between a top sheet and a second acquired sheet.

In a vacuum corrugated feeder as illustrated in FIG. 2 sheets are fed into the paper path using a feedhead 100 which acquires the sheet from the top of a paper stack (not shown). As the top sheet(s) 101 are being acquired, they are forced to bend around a centrally mounted corrugator 102. Since a vacuum is applied directly to the top sheet 101, the deflection of this sheet around the corrugator 102 is greater than any other acquired sheets. This difference in sheet deflection results in the creation of gaps 103 between the top sheet and the other acquired sheets e.g. the second acquired sheet 104. These intersheet gaps 103 are illustrated in FIG. 2, along with the general locations of the corrugator 102, the acquired sheets 104 and the feed belts 105. It should be noted at this point that the feedhead 100 extends over an air knife (not shown). Jets of air from the air knife deflect off the feedhead and into these gaps. This creates an area of relatively high pressure between the sheets stripping the other acquired sheets away from the top sheet. The feed belts then feed the top sheet 101 into the paper path.

Figure 3:
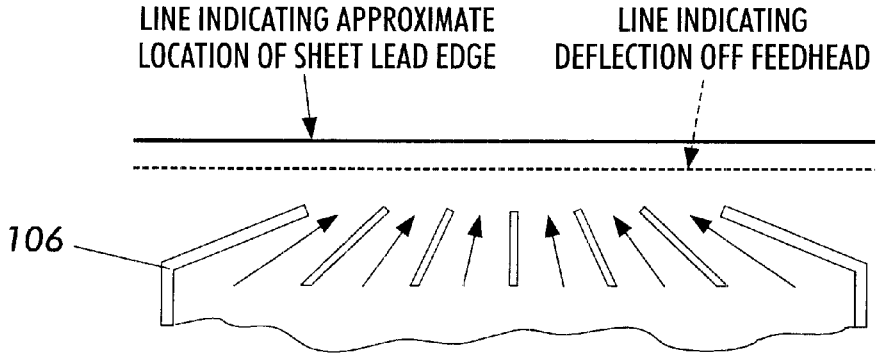
FIG. 3 is a plan view of the airflow distribution about a vacuum corrugated feedhead.
Figure 4:
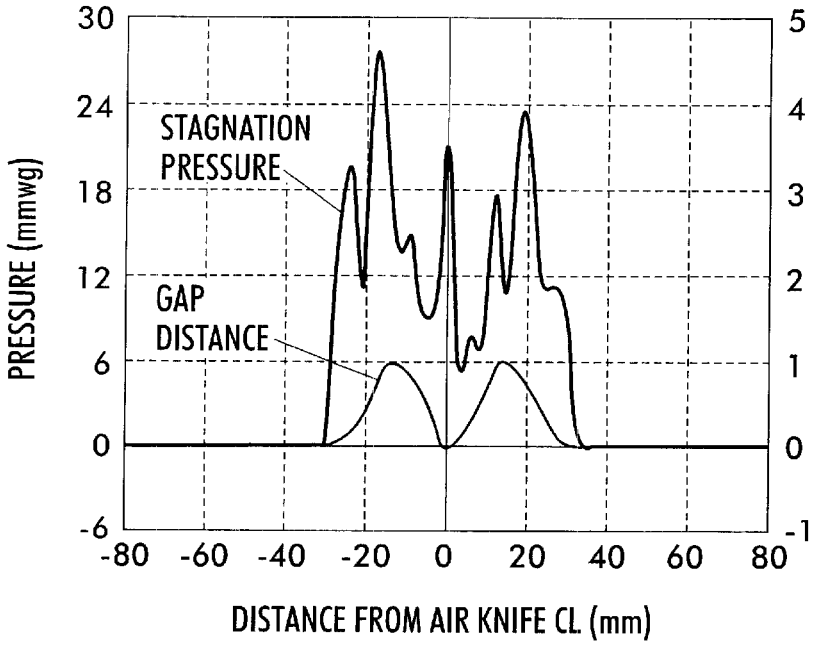
FIG. 4 is a graph illustrating the lead edge of sheet stagnation pressure vs. the distance from an air knife vs gap distance in a typical vacuum corrugation feedhead using 20# paper without incorporating the features of the present invention (air knife pressure set at 60 mmwg)

The focal point of the present invention is concerned with the manner by which air is directed into the intersheet gaps 103. The air knife design used in the system illustrated in FIG. 2 employs a vane configuration, which creates a laterally convergent airflow as shown on FIG. 3. FIG. 3 also indicates the approximate location of the sheet lead edge with respect to the air knife 106. To gain a better understanding of the air knife's performance, the stagnation pressure along the top sheet leading edge was measured. A finite element analysis was also performed on the top sheet 101 (FIG. 2) and the second acquired sheet 104 (FIG. 2) to estimate the gap distance between the sheets normal to the plane defined by the bottom surface of the feedhead. FIG. 4 illustrates a plot showing both the stagnation pressure and the gap distance at the top sheet leading edge when 20# (75 gsm) paper is used. It can be seen that the areas of maximum stagnation pressure correspond reasonably well with the areas of maximum gap distance. It therefore appears that the performance of the air knife is directly related to the degree by which the stagnation pressure areas are matched up with the intersheet gaps.

Much effort was taken to maximize the cross-sectional area of the intersheet gaps. This lead to the development of a vacuum feedhead with multiple corrugators, which served to maximize the gap area across a broad range of substrate basis weights. However, it became apparent that simply creating a large gap area was not sufficient to guarantee acceptable separation of the top sheet from the other acquired sheets. The location of the intersheet gaps relative to the air knife was also found to be important. In FIG. 4, there is illustrated that the areas of high stagnation pressure created by an air knife matched closely with the intersheet gap areas.

Figure 5:
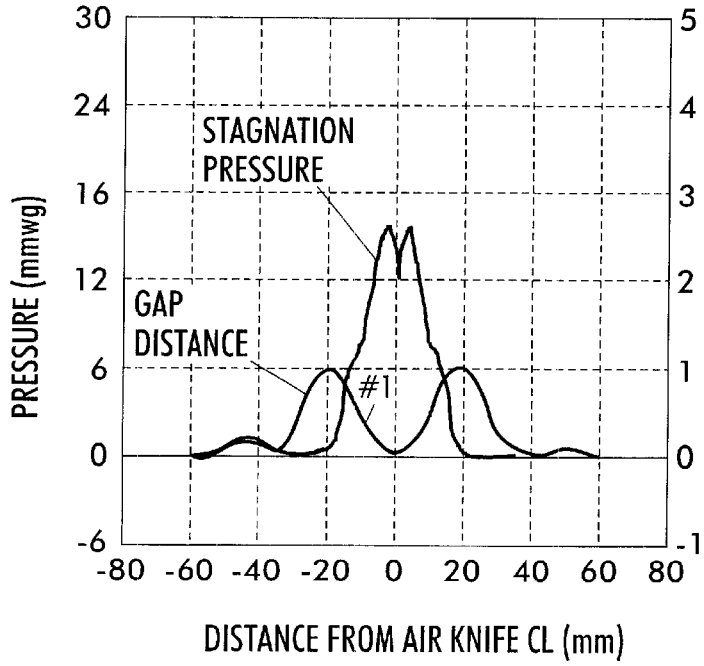
FIG. 5 is a graph illustrating a plot of stagnation pressure vs distance from an air knife vs gap distance in a typical multiple vacuum corrugation feedhead using 20# paper without incorporating the features of the present invention.

FIG. 5 illustrates a similar plot for the multiple vacuum corrugating feeder where the multiple corrugation scheme was used along with known air knife designs. It can readily be seen that the match between the high stagnation pressure areas and the intersheet gap areas could use improvement when compared to vacuum corrugating feeders using a single corrugating member. It can also be seen that the maximum stagnation pressure for the multiple vacuum corrugating feeder is about 60% of the value measured from known vacuum corrugating feeders. This difference is due to the fact that the operating pressure in the multiple vacuum corrugating feeders air knife is 15 mmwg as opposed to the 60 mmwg used in the current vacuum corrugating feeder air knifes.

Figure 6:
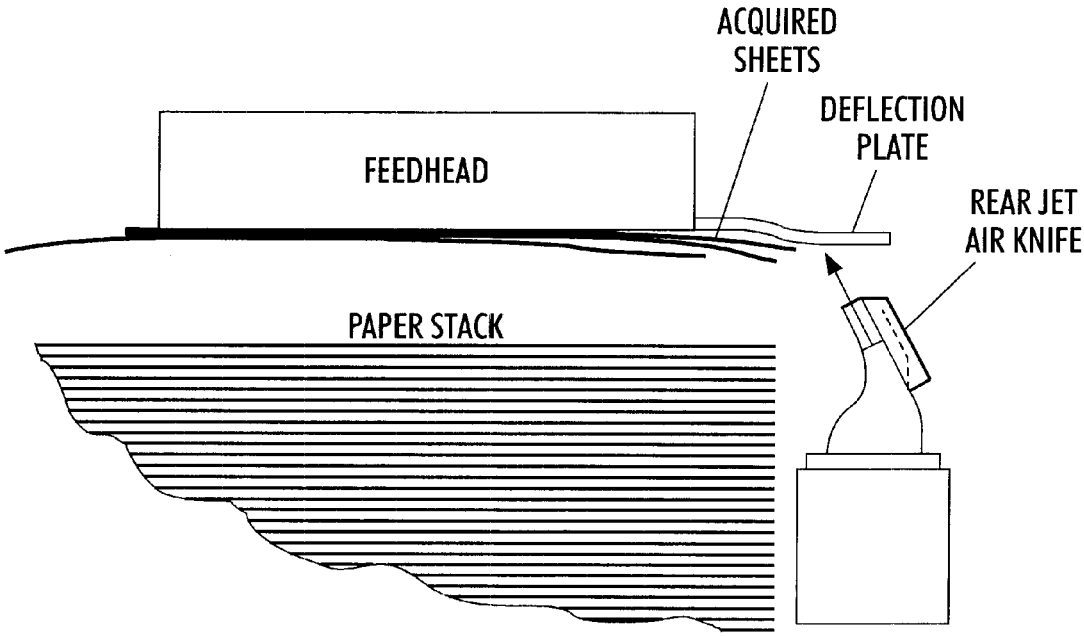
FIG. 6 illustrates a front plan view of a basic layout for a multiple vacuum corrugated feedhead (air knife pressure set at 60 mmwg)
Figure 11:
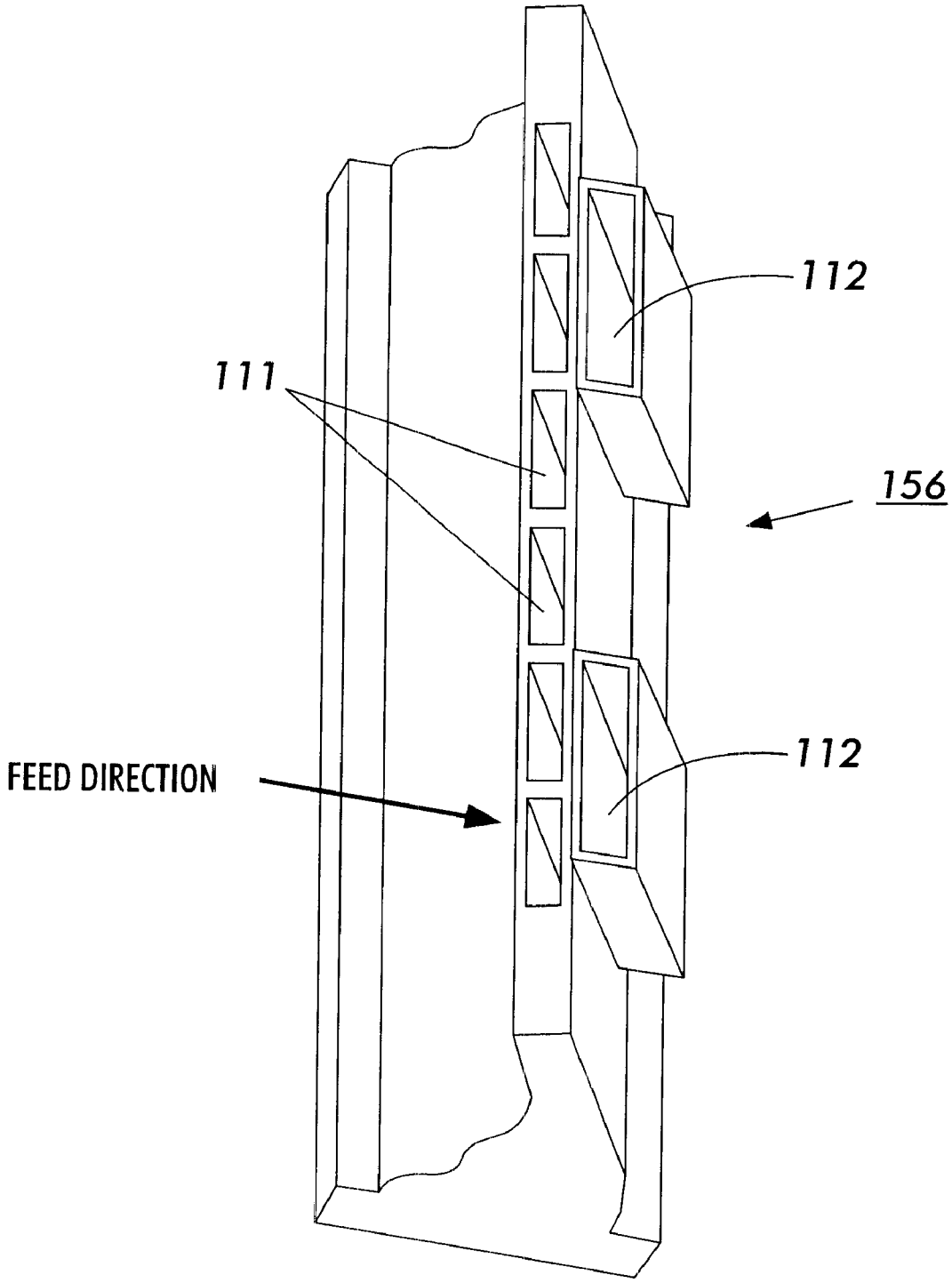
FIG. 11 is a prospective view of a rear jet air knife incorporating two straight nozzles in accordance with the features of the present invention.

The features of the present invention maintain the performance of the known vacuum corrugating feeders air knife designs while also accurately directing air at the intersheet gaps. It was found in accordance with the features of the present invention that adding straight nozzles to the rear of the multiple vacuum corrugating feeders air knife was the best solution. FIG. 6 illustrates a basic layout of a multiple vacuum corrugating feeder, and shows the positions of the major components (excluding the fluffers) relative to the paper stack. FIG. 11 presents a view of the rear jet air knife 156 with the features of the present invention incorporated therein. Illustrated is the top of the air knife as well as the locations of the converging (111) and straight nozzles (112). The vane pattern for the converging nozzle is similar to the configuration shown in FIG. 3. The airflow from both nozzle types is redirected by a deflection plate towards the lead edges of the acquired sheets as shown in FIG. 6. The straight nozzles are located such that the air flowing from them is redirected at the points on the sheet leading edge where the maximum intersheet gaps are expected to be. Thus, the straight nozzles enable the separation of the top sheet from the other acquired sheets while the converging nozzle generates an area of positive stagnation pressure over the stack which holds the sheets down on the stack during the feed process.

Figure 7:
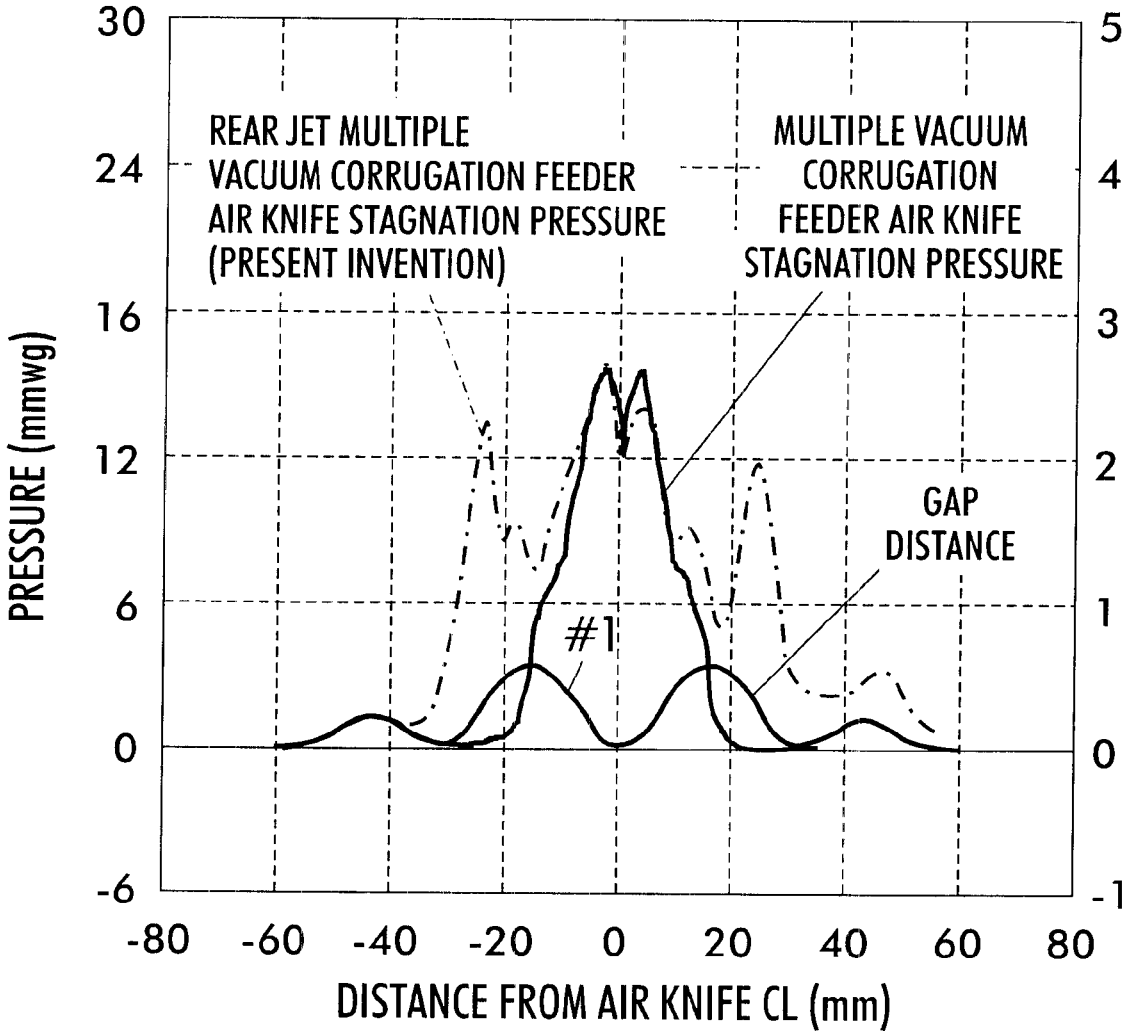
FIG. 7 illustrates a graph similar to FIGS. 4 and 5 except here there is illustrated the effect of a multiple vacuum corrugation feeder air knife having the features of the present invention (i.e. a pair of straight air nozzles extending from the rear portion of the air knife—air knife plenum pressure set at 15 mmwg)

A prototype of the rear jet air knife in accordance with the features of the present invention was constructed and the stagnation pressures at the top sheet lead edge measured. This data is illustrated in FIG. 7. It is readily seen that the rear jet air knife provides better coverage of the intersheet gaps than known multiple vacuum corrugating feeder air knife designs. To quantify the relationship between the intersheet gaps and the stagnation pressure the concept of a lead edge stagnation force; (hereafter referred to as the "stagnation force") was developed. Basically, the stagnation force combines the gap cross-sectional area with the lead edge stagnation pressure. When the stagnation force is calculated for the data illustrated in FIG. 7 it is found that the rear jet air knife generates a force of 0.175 gm verses 0.097 gm for the multiple vacuum corrugating feeder air knife. These numbers indicate that the rear jet air knife incorporating the features of the present invention shows an 80% advantage in stagnation force.

Figure 8:
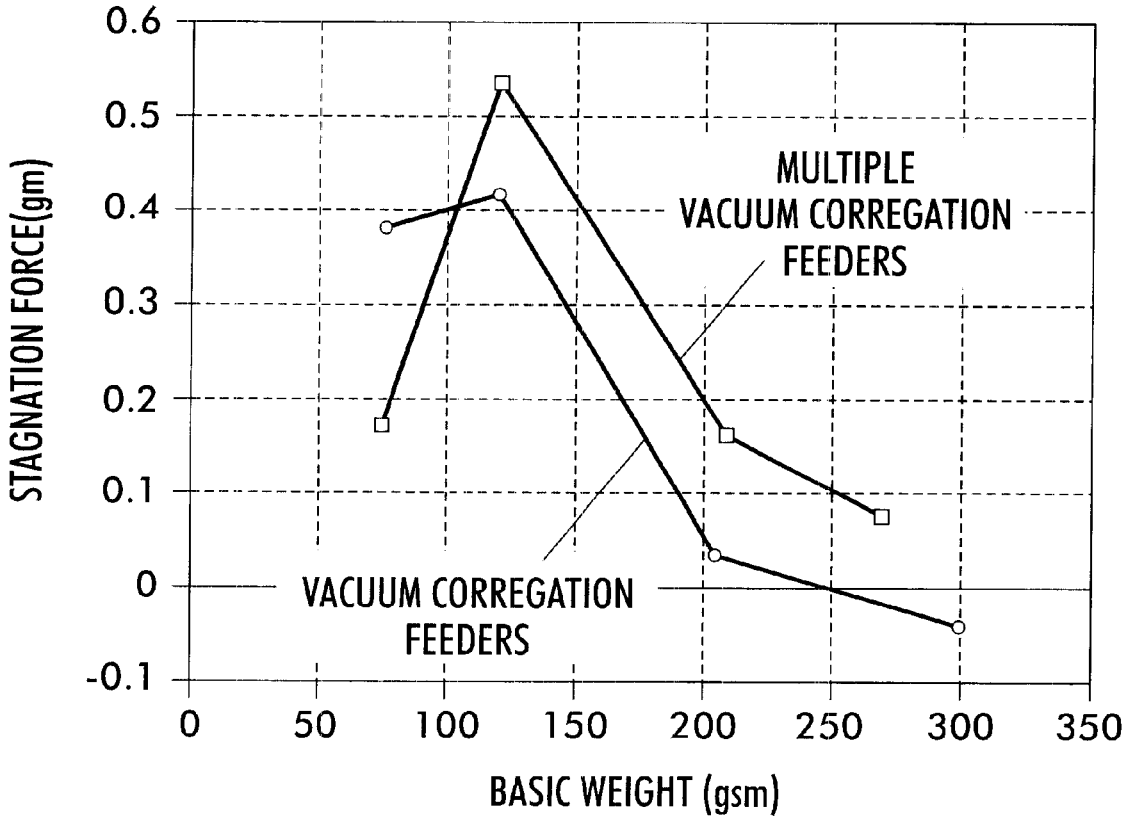
FIG. 8 illustrates a comparison of the ability of a commonly used air knife design against an air knife having the features of the present invention to separate other acquired sheets from the top sheet of a stack of sheets where the stagnation force is a measure of a sheet separation ability and is plotted for a range of media basis weights.

To compare the performance of the rear jet air knife having the features of the present invention against known vacuum corrugating feeders air knife, lead edge stagnation pressure measurements were taken from both the known vacuum corrugating feeders and the multiple vacuum corrugating feeders in accordance with the features of the present invention using papers of several different basis weights. The stagnation forces were then calculated from this data and the results illustrated in FIG. 8. With the exception of 20# (75 gsm) paper the multiple vacuum corrugating feeders in accordance with the features of the present invention outperforms known vacuum corrugating feeders in terms of stagnation force. This represents a major improvement in air knife performance as the known vacuum corrugating feeders air knife requires an operation pressure of 60 mmwg verses 15 mmwg for the multiple vacuum corrugating feeders with rear jet air knife in accordance with the features of the present invention. The lower operating pressures were required by the multiple vacuum corrugating feeders in accordance with the features of the present invention. The use of an air knife having the features of the present invention should result in a lower cost for the air source as well as less noise during operation of the feeder.

The rear jet air knife in accordance with the present invention represents a first in that stagnation pressure measurements were used to match air knife airflow to the intersheet gaps created by the feedhead corrugators. While there has been some knowledge of the air knife creating a "thumbprint" of stagnation pressure on the stack, there appear to be no measurements made at the top sheet lead edge, which seems to be a more accurate indicator of the air knife's ability to separate other acquired sheets from the top sheet as these measurements are at the gap locations. With the rear jet air knife having straight nozzles in accordance with the features of the present invention, the nozzles serve to initiate sheet separation and the converging nozzle provides the thumbprint which holds the sheets down on the stack as the top sheet is fed into the paper path.

Figure 9:
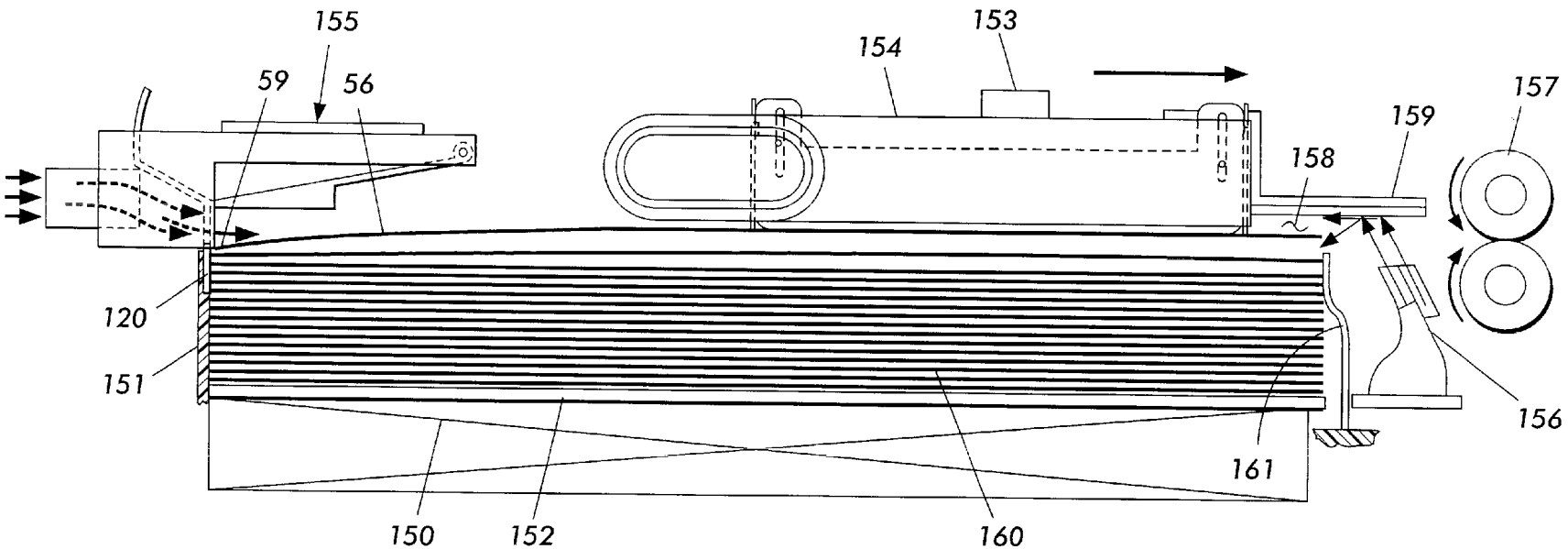
FIG. 9 is an enlarged partial cross-sectional view of a sheet feeder in accordance with the features of the present invention.
Figure 10:
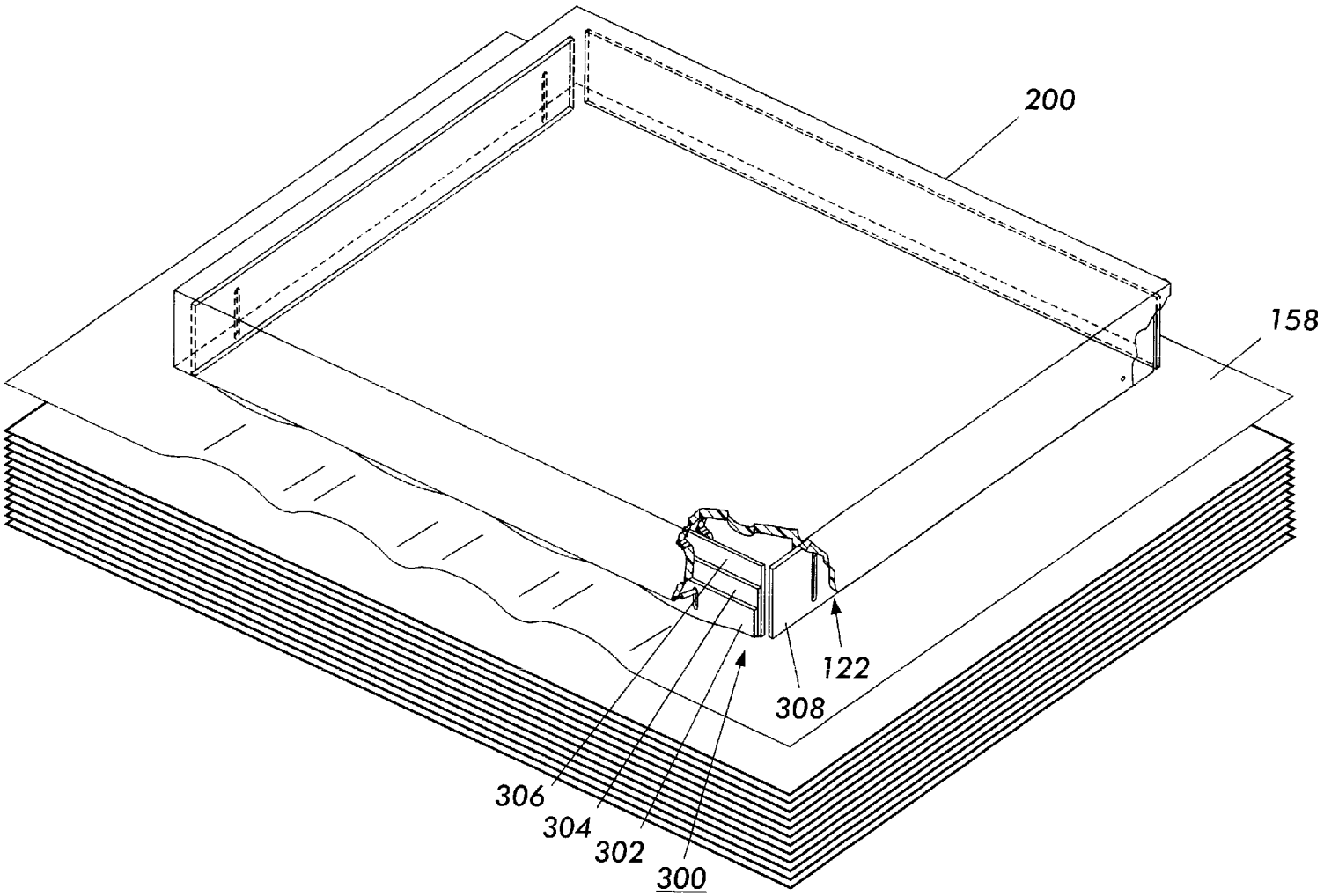
FIG. 10 is a prospective view of an air plenum acquiring sheets from a stack.

FIGS. 9 and 10 illustrate a system employing the features of the present invention in a copy sheet-feeding mode. Alternately, or in addition, the sheet feeder may be mounted for feeding document sheets to the platen of a printing machine. The sheet feeder is provided with a conventional elevator mechanism 150 for raising and lowering either tray 151 or a platform 152 within tray 151. Ordinarily, a drive motor is actuated to move the sheet stack support platform 152 vertically by a stack height sensor positioned above the rear of the stack when the level of sheets relative to the sensor falls below a first predetermined level. The drive motor is deactuated by the stack height sensor when the level of the sheets relative to the sensor is above a predetermined level. In this way, the level of the top sheet in the stack of sheets may be maintained within relatively narrow limits to assure proper sheet separation, acquisition and feeding.

Vacuum corrugation feeder 153 and a vacuum plenum 154 are positioned over the front end of a tray 151 having copy sheets 155 stacked therein. Also shown is an adaptive fluffer 155, a rear jet air knife in accordance with the features of the present invention 156, and take away rolls 157 which form the entrance to the paper path. The configuration shown in figure represents a moment in the feed cycle where vacuum has been applied to the vacuum plenum 154 and a sheet 158 acquired to the feedhead bottom, which has a plurality of corrugating ribs. The effect of these ribs is best seen in FIG. 10, which represents a simplified view of the feedhead 200 and the effect of the applied vacuum on the acquired sheet 158. Also shown in FIG. 10 are the articulating vacuum seals 300, 302, 304, 306, and 308 which ensures a minimal amount of air leakage into the plenum. As the sheet deforms around the ribs contained within the feedhead, the lower left edge of the paper corrugates as shown. Should other sheets be drawn up with the top sheet 158, the significantly lower force applied to those sheets would result in reduced corrugation, thereby creating gaps between the top sheet 158 and any other acquired sheets.

A more detailed view of the improved air knife 156 from FIG. 9 showing the features of the present invention is illustrated in FIG. 11. The rear jet ports 112 are located so as to best match the corresponding areas on the feedhead 153 (see FIG. 9) where the largest intersheet gaps will occur, and provide an adequate stagnation force (or separation force) by directing air onto the deflection plate 159 which deflects air into the gaps. The main function of the converging jet ports 111 is to create an air flow pattern which maintains a downward force on the stack (know in the art as a "thumbprint") so as to ensure that the leading edge of any other sheets are located below the sheet retainers 161, also known in the art as fangs. This acts to prevent the incidence of coincident sheet feeds (also knows as multifeeds), which are a significant source of system shutdowns.

The operation of the feeder 153 with the improved air knife 156 can be summarized as follows. FIG. 9 also illustrates the feeder operation at a point just prior to the top sheet 158 being translated to the take-away rolls 157. Air from a pressure source such as a centrifugal blower is supplied to the air knife via a duct. The air flow is controlled by a valve, which applies air to the air knife according to set operating parameters. At this point in feeder operation, the valve is open, and air flows through the air knife 156, deflects off the deflection plate 159, and into any existing gaps between the acquired top sheet and any other acquired sheets. After a set period of time during which the other acquired sheets have been forced back onto the stack, the top sheet is translated into the take-away rolls 157. This is accomplished by moving the entire feedhead 154 towards the rolls with sufficient distance such that the leading edge of the top sheet enters the nip between the rolls. There are several known mechanisms which can be used to translate the feedhead, and the design of such is well known in the art. Just before the sheet enters the nip, the vacuum supply is shut off by a valve, allowing the sheet to freely enter the nip. The feedhead 154 then returns to its original position. The valve controlling the vacuum supply to the feedhead plenum 154 opens, and the resulting vacuum draws the next sheet up against the feedhead.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. A top sheet feeding apparatus for feeding sheets from a stack of sheets comprising a sheet stack support tray for supporting a stack of sheets, an air fluffer positioned adjacent the stack of sheets, an air knife device positioned adjacent the front of the stack of sheets for applying a positive pressure to the sheet stack in order to separate the uppermost sheet in the stack from the rest of the stack, and a feedhead device including a vacuum plenum chamber positioned over the front of the sheet stack having a negative pressure applied thereto during feeding, the vacuum plenum chamber having a sheet corrugation member located in the center of its bottom surface and perforated feed belt means associated with the vacuum plenum chamber to transport the sheets acquired by said vacuum plenum chamber in a forward direction out of the stack support tray, wherein the air knife device includes a first air nozzle and a pair of second air nozzles extending from the rear portion of the air knife device, the second air nozzles being located different than the first air nozzle relative the front of the sheet stack, and having a substantially constant cross-section.

2. A top sheet feeding apparatus according to claim 1 wherein said second air nozzles are matched to intersheet gaps between a sheet being fed and the next sheet in said stack.

3. A top sheet feeding apparatus according to claim 2 wherein said intersheet gaps are formed as a result of said corrugation member which is modified to maximize the gap.

4. A top sheet feeding apparatus according claim 1 wherein said air knife device provide only sufficient air pressure to hold down said sheets in said stack, and said second air nozzles provide sufficient air pressure to separate said sheets.

5. A top sheet feeding apparatus according to claim 1 wherein said rear vacuum plenum chamber and said air knife device are stationary.

6. A top sheet feeding apparatus according to claim 1 wherein said stack of sheets is rear edge registered.

7. A top sheet feeding apparatus according to claim 1 wherein said apparatus is used with an electrophotographic apparatus to feed sheets.

8. A top sheet feeding apparatus according to claim 1, wherein the first air nozzle of the air knife device is a converging nozzle.

* * * * *